US005794803A

United States Patent [19]

Sprick

[11] Patent Number: 5,794,803

[45] Date of Patent: Aug. 18, 1998

[54] CHILD-RESISTANT MEASURING CUP CLOSURE AND DISPENSING CONTAINER

[75] Inventor: William Douglas Sprick, Evansville, Ind.

[73] Assignee: Rexam Closures, Inc., Evansville, Ind.

[21] Appl. No.: 742,803

[22] Filed: Nov. 1, 1996

[51] Int. Cl.[6] ..... B65D 55/02; B67D 1/16

[52] U.S. Cl. ..... 215/217; 215/219; 215/330; 222/109; 222/571; 222/566

[58] Field of Search ..... 220/288; 215/329, 215/330, 216–219, 221, 44; 222/461, 542, 566, 567, 569, 570, 571, 109

[56] References Cited

U.S. PATENT DOCUMENTS

| | | | |
|---|---|---|---|
| 3,894,647 | 7/1975 | Montgomery | 215/216 |
| 3,989,152 | 11/1976 | Julian | 215/216 |
| 4,134,513 | 1/1979 | Mumford | 215/216 |
| 4,213,534 | 7/1980 | Montgomery | 215/216 |
| 4,452,363 | 6/1984 | Davis | 215/216 |
| 4,540,098 | 9/1985 | Luker | 215/216 |
| 4,671,421 | 6/1987 | Reiber et al. | 215/44 X |
| 4,706,829 | 11/1987 | Li | 220/288 X |
| 5,078,288 | 1/1992 | Fuchs | 215/218 X |

*Primary Examiner*—Allan N. Shoap
*Assistant Examiner*—Nathan Newhouse

[57] ABSTRACT

A child-resistant closure and dispensing container package in which the measuring cup has a second, exterior annular wall forming threads engageable with threads on the neck of a container and child-resistant lock means at a lower portion of the wall engageable with complementary lock means on the container in a locked position to prevent unthreading of the closure from the container until the annular wall is deflected to move the complementary lock means out of engagement with each other to permit rotation of the closure in an unthreading direction. Also a seal is provided to prevent leakage during unthreading movement of the closure between fully closed and a locked position of the closure.

4 Claims, 2 Drawing Sheets

CHILD-RESISTANT MEASURING CUP CLOSURE AND DISPENSING CONTAINER

This invention relates to child-resistant closures and containers, and more particularly to child-resistant closures which act as measuring cups for the contents of the container with which the closure is used.

In measuring cup closures used with dispensing containers, the concern usually is for maintaining the container contents isolated from the threads of the container, to prevent leakage or spillage of the contents, and to facilitate drainage of the remaining contents of the cup upon replacement on the container. Little concern has been given to the access of such containers by young children, and there is a need for such closures to be child-resistant and leak proof.

One of the problems of child-resistant closures is that slight opening movement is permitted between a fully closed position and the position in which the child-resistant feature comes into operation. During such movement the seals must prevent leakage but in most instances any opening movement causes unsealing and results in leakage.

It is an object of the invention to provide a child-resistant measuring cup closure and dispensing container in the form of a package in which the child-resistant features can be exercised effectively and simply without impairing the effectiveness of the dispensing and measuring features.

It is another object to provide a child-resistant package in which sealing is maintained in a closed condition of the package during any opening movement that occurs prior to the child-resistant feature coming into operation.

The present invention contemplates a closure in the form of a measuring cup having a second threaded skirt outwardly of the inner skirt which is provided with child-resistant features requiring a deflection of the outer skirt to disengage the lock means which otherwise obstruct unthreading movement of the closure from the container until the closure is squeezed at designated locations to disengage the lock means.

The objects of the invention are obtained by a child-resistant closure and container assembly wherein a cup-shaped closure forming a measuring cup has a cylindrical skirt disposed within the neck of a dispensing container wherein an annular wall is disposed coaxially in radially spaced relation to the skirt to form an annular cavity receiving the neck of the container. The interior of the annular wall is provided with threads for engaging threads on the neck of the container and child-resistant lock means are formed on the annular wall in spaced relation to the threads so that the lock means engage complementary lock means on the container to prevent unthreading until the annular wall is deflected to move the closure associated lock means out of engagement with the lock means on the container to permit complete unthreading of the closure from the container. During such unthreading movement from a tightly closed position to the locked position in which the child-resistant features come into operation, a seal is maintained between the closure and fitment to prevent leakage of the container contents.

DETAILED DESCRIPTION

Figure 1:
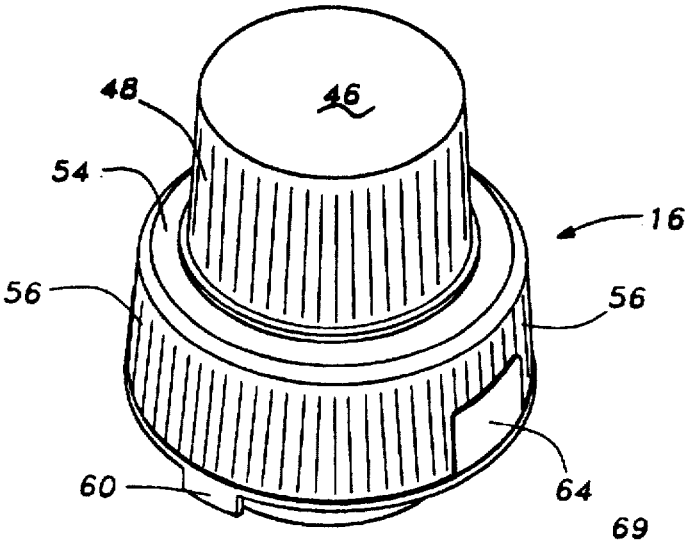
FIG. 1 is a perspective view of the closure embodying the, invention removed from the container.

Referring to the drawings, a preferred embodiment of the invention is in the form of a container and closure assembly made up of a dispensing container 12, incorporating a pouring spout fitment 14 and a closure 16 in the form of a measuring cup which acts also to close the pouring spout 14 and container 12.

Figure 2:
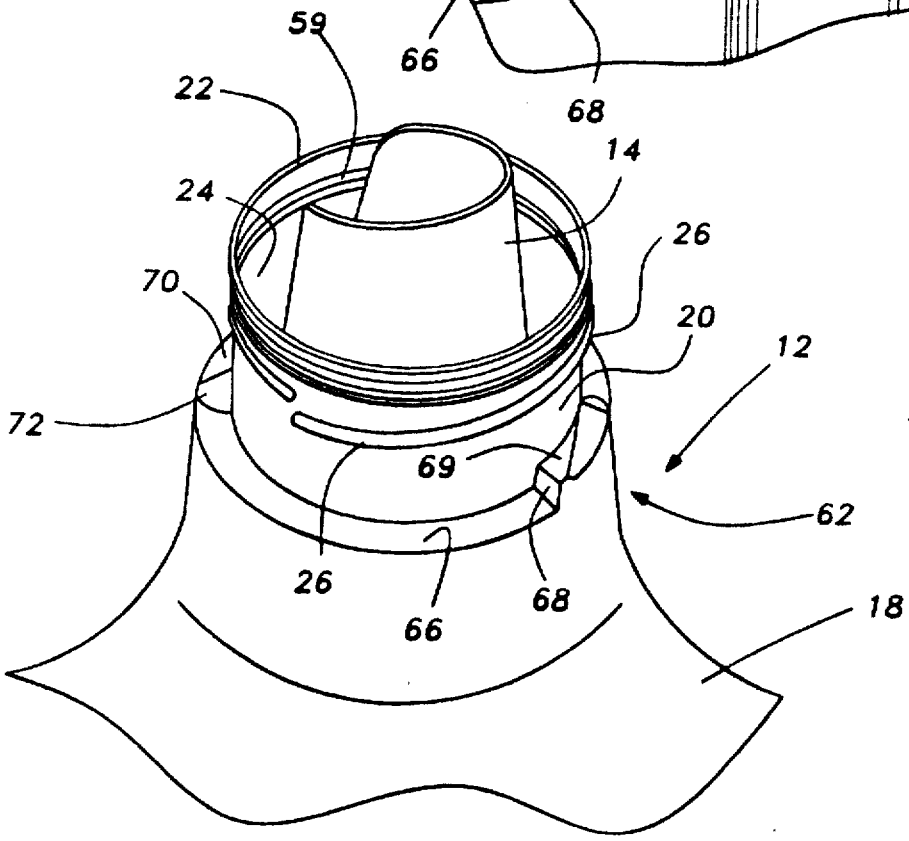
FIG. 2 is a perspective view of the container with the closure removed.

The container 12 has a body portion 18 which preferably is blow molded of synthetic plastic material to accommodate pourable liquids such as laundry detergents and bleaches, for example. The upper end of the body 18 is provided with a cylindrical neck 20 having a lip 22 at its upper end defining an opening 24 to the body 18 of the container 12 as seen in FIG. 2. The upper end of the neck 20 adjacent to the opening 24, is provided with external threads 26 to receive complementary threads 28 on the closure 16.

Figure 4:
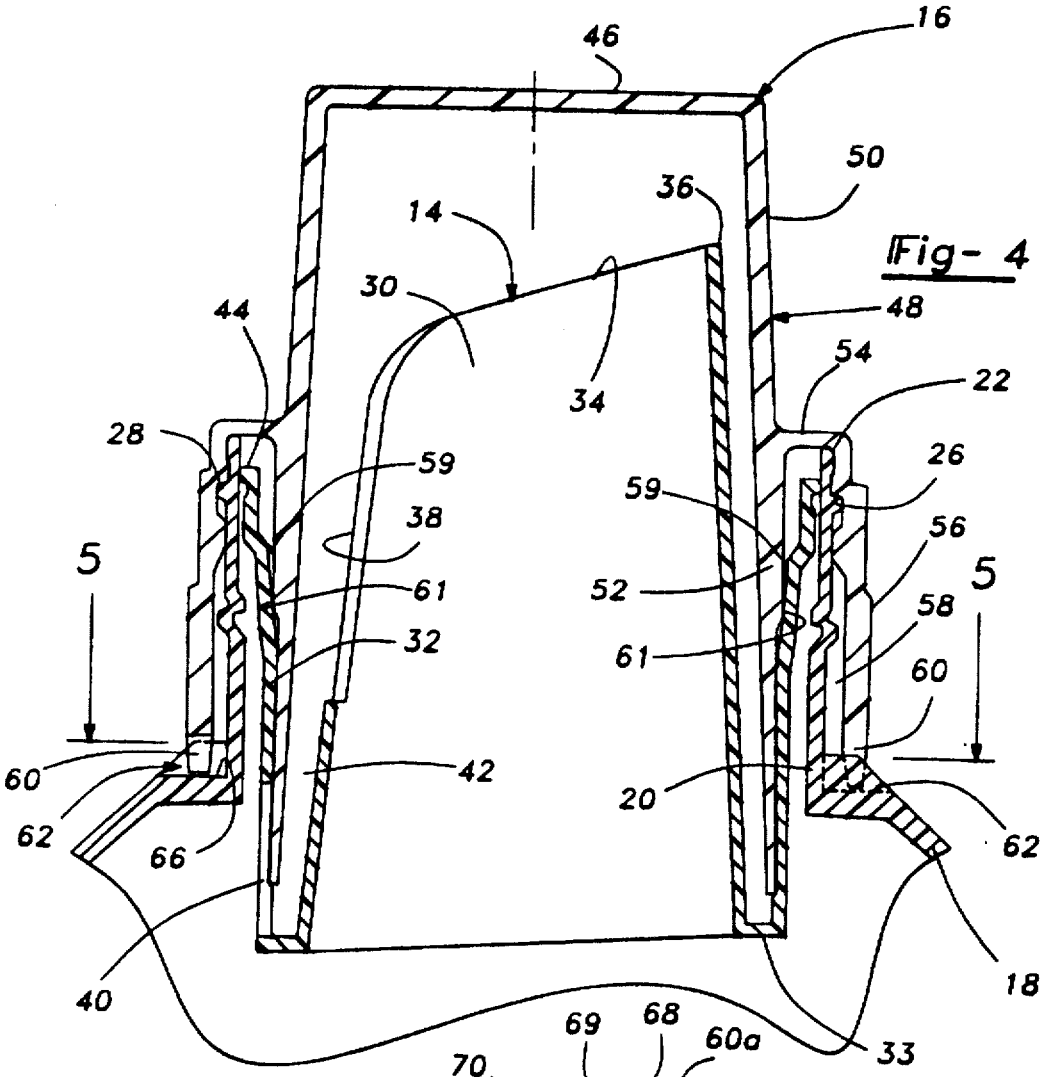
FIG. 4 is a cross-sectional view of the closure and container in a closed condition.

As best seen in FIG. 4, the pouring spout fitment 14 also is made of plastic and includes a generally tubular pouring spout 30 disposed concentrically with an annular sheath 32. The lower end of the spout 30 and the lower end of the sheath 32 are joined together with each other by an annular wall as indicated at 33. The spout 30 has a tapered upper edge 34 which forms a pouring lip 36 at the uppermost portion of the spout 30. The open end of the spout is continued with a slot 38 which extends diametrically opposite the pouring lip 36. Also, diametrically opposite the pouring lip 36, the sheath 32 is provided with a drain-back opening 40 which communicates the annular cavity 42 formed between the spout 30 and the sheath 32 with the inside of the container body 18 to permit drainage of any liquid that may accumulate in the cavity 42.

The upper end of the sheath 32 is provided with a lip 44 which is fastened to the inside surface of the upper end of the neck 20 in a fixed position and made integral with the container 12 to prevent leakage. This is accomplished, in a preferred embodiment of the invention, by spin welding in which the fitment is rotated rapidly relative to the container so that the heat of friction causes bonding of the plastic in the container and fitment. In this condition, the spout 30 projects above the lip 22 of the neck 20.

The closure 16 is in the form of a measuring cup having a flat disc shaped wall 46 from which an annular skirt 48 extends. The skirt 48 has an upper portion 50 which projects above the lip 22 of the neck 20 and a lower portion 52 which extends coaxially with the neck 20 and the pouring spout 30, and is disposed in the annular cavity 42 formed by the spout fitment 14.

An annular flange 54 extends radially outwardly from the skirt 48 between the upper and lower skirt portions 50 and 52. A cylindrical wall 56 extends axially from the outer edge of the annular flange 54. The wall 56 is concentric with the skirt portion 52 and the interior end of the wall 56 adjacent to the flange 54 is provided with the closure threads 28 which are complementary to the threads 26 on the neck 20 of container 12. The threads 28 are formed at the upper end of wall 56 near the juncture with flange 54 at which point the wall 56 is relatively stiff. The lower end of wall 56 is flexible and can be easily deflected.

The cylindrical wall 56 and the lower skirt portion 52 define the opposite walls of an annular cavity 58 which receives the neck 20 and the spout sheath 32 when the threads 26 and 28 are engaged with each other to hold the closure 16 on the container 12. In reaching the closed position, the lower skirt portion 52 engages the inner wall of the sheath 32 to provide wiping action between the closure and container.

The inner surface of sheath 32 of fitment 14 is provided with an integral annular seal 59 (FIG. 2) which engages cylindrical sealing surface 61 formed on the outer surface of skirt portion 52 (FIG. 4). The sealing surface 61 extends axially a sufficient amount to accommodate sealing over a range of axial movement of closure 16 relative to neck 20. Seal 59 acts as the primary seal to prevent leakage of contents from the package 10.

The lower end of the cylindrical wall 56 is provided with lock members 60 which coact with diametrically opposed lock elements 62 disposed on the shoulder 66 formed at the lower portion of the neck 20. The lock members 60 are in the form of axially extending tabs coextensive with the annular wall 56.

The cylindrical wall 56 adjacent to the lock members 60 is sufficiently flexible that it can be deflected radially inwardly by finger pressure exerted at diametrically opposed pressure points indicated at 64 in FIG. 1. The pressure points 64 are spaced circumferentially midway of the lock member 60 so that inward pressure shapes the lower portion of wall 56 in an oval to cause the lock members 60 to move radially outwardly away from each other to the positions indicated at 60*a* in FIG. 5. The lock members 60 on the closure 16 act with lock elements 62 disposed in diametrically opposed relationship to each other on the shoulder 66 formed between the neck 20 and the container body 18 to prevent unthreading of the closure 16 from the container 18.

Figure 3:
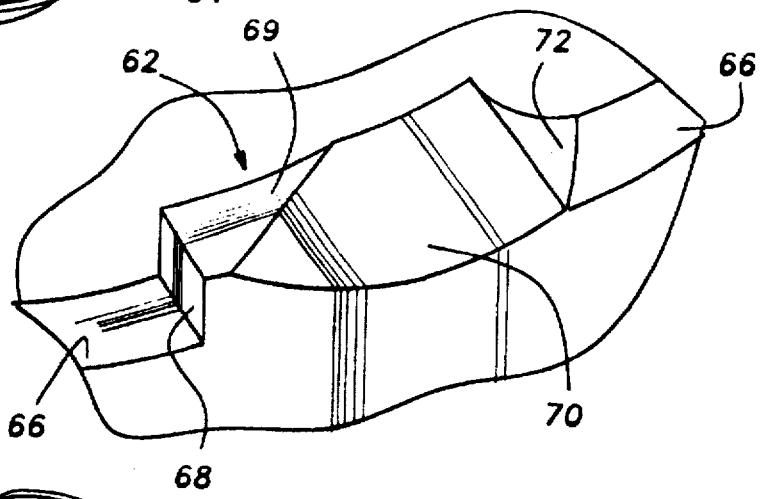
FIG. 3 is an enlarged perspective view of a portion of the container in FIG. 2.
Figure 5:
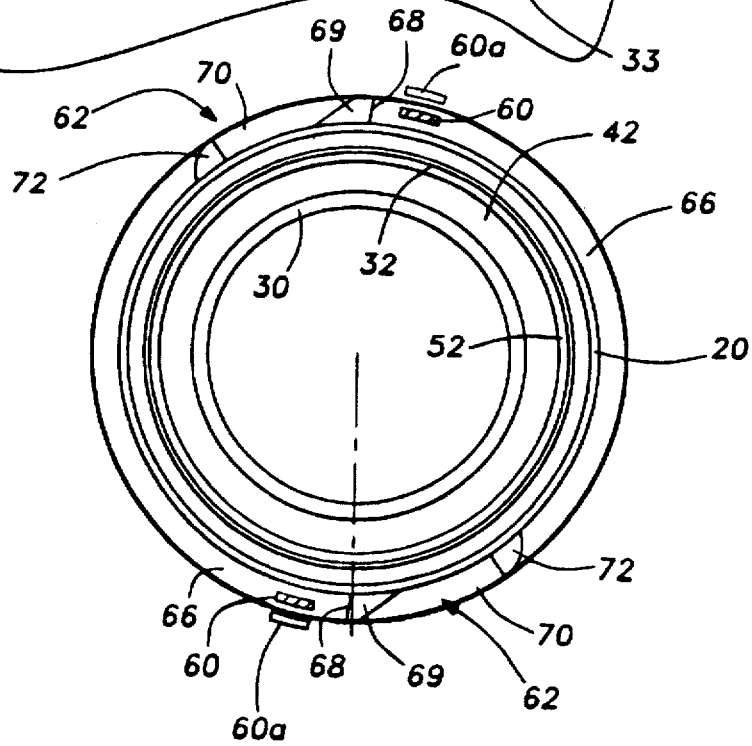
FIG. 5 is a cross-sectional view taken on line 5—5 in FIG. 3.

As seen in FIG. 3, the lock elements 62 have a vertical lock wall 68 which extend vertically from the shoulder 66 and are disposed at a slight angle of approximately ten degrees to the radius of the neck 20 to form a generally hook-like wall surface. This tends to direct the lock members 60 radially inwardly upon the application of a large twisting force in the opening direction and makes it difficult to overcome the locked closure with force alone. Each of the lock elements 62 also has a top flat surface 69 which is generally triangular in shape when viewed from above as seen in FIG. 5. The outer edges of surface 69 merge with a downwardly and outwardly sloping surface 70 which merges with a conical surface 72 to blend the surfaces gradually into the shoulder surface 66.

When the closure 16 is applied to the container 12, lock members 60 engage the conical surface 72 and then the sloping surface 70 to gradually deflect the lock members 60 radially outward until they reach a position beyond the vertical lock walls 68 at which the lock members 60 may move radially inwardly in the absence of any pressure at points 64. Also, the closure can be rotated to a fully closed position which usually is spaced up to one half of a turn from the locked position.

During initial unthreading of the closure 16 from the container 12, the closure is rotated relative to the container from a tightly closed position until lock members 60 engage the vertical walls 68 and prevent further unthreading motion of the closure relative to the container 12. To release the closure 16, it is necessary to press radially inwardly at diametrically opposed pressure points 64. This deflects the annular wall 56 radially inwardly adjacent to the pressure points and at the same time causes the lock members 60 to move radially outwardly to a position radially beyond the outer extent of the lock elements 62 as indicated at 60*a* in FIG. 5. With continued pressure at the pressure points 62, the closure 16 can be rotated in an unthreading direction without obstruction to the lock members 60 from the lock element 62. Such operation provides a child-resistant feature of the closure by which two simultaneously executed actions are required to open the container, namely radial inward pressure at diametrically opposed points and simultaneous rotation of the closure in an opening direction.

The closure can be moved between its tightly closed position and the locked position in which the child-resistant feature comes into play. During such movement, the closure rotates and moves axially due to the action of coacting threads 26 and 28. The seal 59 engages the sealing surface 61 and functions continuously during such rotational and axial movement to prevent leakage.

A child-resistant closure and container package has been provided in which the child-resistant features which must be overcome are associated with an outer wall of a measuring cup in a location which does not interfere with the measuring and pouring features of the assembly. The assembly also achieves sealing against leakage of contents during efforts to open the container and before the child-resistant feature comes into operation.

I claim:

1. A child-resistant liquid containing package comprising:

a container having a neck with external threads adjacent one end of said neck, a fitment fixed to said neck having a pouring spout projecting from said neck and an annular sheath coaxial with said spout to form an annular cavity between said spout and said neck, a cup shaped closure having a top and a skirt extending from said top and being disposed in said annular cavity with said top being positioned axially beyond the end of said spout when said closure is in a closed position, an outer annular wall spaced radially outward and connected coaxially with said skirt and having an annular lip at one end, threads complementary to said externally threaded neck formed on the interior of said wall adjacent said top, said annular wall adjacent said lip being flexible for deflection radially outwardly at first opposed locations in response to deflection radially inwardly at second opposed locations, lock members on said annular lip of said skirt adjacent said first opposed locations, and lock elements on said container for engagement with said lock members at a locked position to prevent unthreading of said closure from said container, said lock members being movable radially outwardly out of engagement with said lock elements to permit unthreading of said closure from said container upon radially inward deflection of said skirt at said second opposed locations for removal of said cup shaped closure to expose said spout.

said closure being rotatable a limited amount from a tightly closed position to said locked position, and an annular seal on an inner wall surface of said sheath engagable with the outer surface of said skirt of said closure, said seal remaining in sealing engagement with said skirt during rotational and axial movement relative to said neck between said tightly closed and said locked positions of said closure and container, said outer surface from an intermediate portion to a lower portion of said skirt of said closure remaining in contact with said inner wall surface of said sheath during closing movement of closure on said neck to provide a wiping action of liquid from said outer surface, 2. The combination of claim 1 and further comprising a shoulder extending radially from the other end of said neck, said lip being in close proximity to said shoulder when said closure is in a closed position on said container.

3. The combination of claim 2 wherein said lock elements are formed on said shoulder.

4. The combination of claim 1 wherein said fitment is fixed to said neck by spin welding.

* * * * *